US005095684A

United States Patent [19]

Walker et al.

[11] Patent Number: 5,095,684

[45] Date of Patent: Mar. 17, 1992

[54] ON EDGE COOKIE LOADER

[75] Inventors: William D. Walker, Athens; Charles T. Haley, Watkinsville; Daniel W. Pruett, Auburn, all of Ga.

[73] Assignee: Food Machinery Sales, Inc., Athens, Ga.

[21] Appl. No.: 607,036

[22] Filed: Oct. 31, 1990

[51] Int. Cl.[5] ..... B65B 23/14; B65B 35/44; B65B 35/50

[52] U.S. Cl. ..... 53/443; 53/446; 53/447; 53/473; 53/500; 53/504; 53/532; 53/534; 53/544; 53/247; 53/254; 198/462; 414/798.2

[58] Field of Search ..... 53/446, 447, 473, 500, 53/504, 532, 539, 540, 542, 534, 247, 249, 254, 443; 198/462, 419.1; 414/798.2, 798.7, 790.3

[56] References Cited

U.S. PATENT DOCUMENTS

| | | | |
|---|---|---|---|
| 2,604,972 | 7/1952 | Schmied | 198/462 |
| 3,236,162 | 2/1966 | Reist | 414/798.2 X |
| 3,290,859 | 12/1966 | Talbot . | |
| 3,500,984 | 3/1970 | Talbot | 198/32 |
| 3,832,823 | 9/1974 | Currie | 53/473 |
| 3,842,719 | 10/1974 | Fernandez-Rana et al. | 414/798.2 X |
| 4,098,392 | 7/1978 | Greene | 53/532 X |
| 4,394,899 | 7/1983 | Fluck | 198/408 |
| 4,413,462 | 11/1983 | Rose | 53/540 |
| 4,611,705 | 9/1986 | Fluck | 414/798.9 |
| 4,641,489 | 2/1987 | Wood | 53/542 X |
| 4,712,356 | 12/1987 | Hardage et al. | 53/447 X |
| 4,718,538 | 1/1988 | Low et al. | 198/462 X |
| 4,768,328 | 9/1988 | Mims | 53/542 X |
| 4,788,812 | 12/1988 | Morita et al. | 53/447 |
| 4,962,844 | 10/1990 | Francioni | 198/462 X |
| 5,022,644 | 6/1991 | Bürge | 198/460 X |

*Primary Examiner*—Horace M. Culver
*Attorney, Agent, or Firm*—Hopkins & Thomas

[57] ABSTRACT

Cookies (30) of uniform but irregularly shaped perimeter are received from the cookie oven in a horizontal as-baked attitude onto a first surface conveyor (19). As the cookies are passed to successive surface conveyors 920) and (21) operating at successively decreased velocities, the cookies are raised to an edge standing attitude abutting one another. Laser detecting means (24–26) are positioned above the conveyors (19–21), and measure the height of the edge stacked cookies and adjust this height by varying the speed of the successive conveyors (19, 20 and 21). A counting means (28) at the discharge end of conveyor (21) counts out a predetermined number of cookies to be placed upon the loader (16) for loading into a cookie tray (104), and a pair of separator blades (42, 43) separates these cookies on the loader from the cookies remaining on surface conveyor (21). A cookie tray (104) is positioned under the loader (16) by a cookie tray conveyor (18).

25 Claims, 5 Drawing Sheets

ON EDGE COOKIE LOADER

FIELD OF THE INVENTION

This invention relates to a method and apparatus for loading of a series of edible cookies or similar items moving on a conveyor system into trays in an edge-standing attitude.

BACKGROUND OF THE INVENTION

In the production and packaging of cookies and similar baked items, cookie dough, etc. is deposited on a plurality of parallel conveyor tapes, and the conveyor tapes move the cookie dough through an oven. Usually the conveyor tapes carry the hot baked cookies beyond the oven and through an enrobing device and a cooling area. The enrober coats the cookies with chocolate, etc. and the cooler not only reduces the temperature of the cookies but causes the cookies to become less pliable, more stable and less sticky. Once the cookies have been cooled, the cookies must be stacked and loaded into cookie trays or other receptacles for shipment to the retail market. Typically, the infeed conveyor tapes each move the cookies at a rate of 350 to 450 cookies per minute through the oven, and there can be from 16 to 30 lines of conveyor tapes operating at a single time in one cookie production system.

In the past, the cookies would be gathered by hand from the conveyor lines and placed in containers, such as bags, etc. This hand loading process occasionally caused too many or too few cookies to be placed in a package, and a substantial amount of breakage and waste resulted from the hand operations. Further, hand loading of cookies is expensive.

Automated cookie loading devices have been developed in recent years which avoid the expense of manual handling of the cookies and which can function to place the proper number of cookies in each container. For example, U.S. Pat. Nos. 3,290,859, 3,500,984, 4,098,392, 4,394,899, 4,413,462 and 4,718,538 disclose automated machines for loading cookies and similar items into containers.

It has become popular for cookies to be merchandized in open topped trays which hold the cookies in edge standing attitude so that a large number of cookies occupy a relatively small space, and so that the tray can protect the cookies from external impact and abrasion with respect to other products and avoid deterioration of the cookies in the packages. When cookies are placed in a cookie tray, usually two or three rows of cookies for one tray, it is desirable that the cookies be properly oriented in the tray. It is relatively easy to stack circular cookies into cookie trays because it does not matter if the cookies have been rotated somewhat with respect to each other; however, when the uniformly but irregularly shaped non-circular cookies are to be stacked in a cookie tray, it is important that the cookies all be uniformly oriented within the tray. Typically, the rectangular cookies will be placed in side edge standing relationship, so that the lengths of the cookies extend across the cavity of the tray and the widths of the cookies extend vertically.

In order to achieve this uniform orientation of the side edge standing cookies within the cookie trays, it is desirable that the cookies be oriented on the conveyor system leading away from the cookie oven and toward the loader in a shingle stacked side edge standing relationship, and that the cookies in the shingle stack be oriented substantially vertically as the cookies are transferred from the line of cookies on the conveyor system to the cookie trays. With this process, the stacking mechanism does not have to contend with cookies that are not properly oriented, so that the stacking function can simply transfer the properly oriented cookies to the awaiting cookie trays.

SUMMARY OF THE INVENTION

Briefly described, the present invention comprises a method and apparatus for automatically loading cookies and the like of uniform but irregular shapes into cookie trays. The cookies are received in a horizontal as-baked attitude with the cookies resting with their flat bottom surfaces on the conveyor tapes which transport the cookies away from a cookie oven. Each line of cookies leading to a loader is transported by a series of surface conveyor tapes, and the speeds of the tapes are controlled so as to properly reorient the cookies from the as-baked attitude to a side edge standing shingle stacked attitude. For example, the transport conveyor tape leading from the cookie oven, enrober and cooler typically moves between 40 and 50 feet per minute, with the cookies spaced apart on the conveyor tape. When smaller cookies are being processed, the spaces between cookies might be slightly larger than when larger cookies are being processed. The first stacking conveyor of the stacking section of the cookie loader operates at a slower speed than the infeed conveyor, and the first stacking conveyor is positioned lower than the infeed conveyor, so that when the cookies are transferred from the infeed conveyor to the first stacking conveyor, the cookies will drop about 1½ inch, depending on the size of the cookies and will partially overrun the previous cookie so that the cookies come to rest on the first stacking conveyor in a shingle stacked relationship. The entrances of the second and third stacking conveyors are positioned at the same level as the exit of the preceding stacking conveyor, but these conveyors are operated at slower speeds respectively so as to increase the height of the shingle stack of the cookies, so that the cookies are delivered by the last stacking conveyor to the loader in substantially vertical orientation.

As the cookies progress from horizontal to vertical side edge standing attitudes, they are passed over a vibrator plate which vibrates the cookies laterally and longitudinally to thus cause the cookies to become more perfectly oriented.

Sensors are placed at each transition from one conveyor belt to the next so as to detect the presence of and number of the cookies on the conveyor system and in some instances to detect the height of the shingle stacked cookies. The speeds of the conveyor belts are controlled in response to the detections of the cookies so as to properly control the cookies as they approach the loader. Thus the height of the stack of cookies is controlled by the detectors speeding up and slowing down the conveyor belts to lower and raise the height of the stack of cookies.

The gate and loader divide the line of vertically stacked cookies into "slugs" or groups of cookies and load each slug of cookies to a cavity of an awaiting cookie tray.

When the cookies progressively approach a vertical, edge standing attitude on the stacking conveyor system, progressively more horizontal force is applied from one cookie to the next adjacent cookie throughout the horizontally stacked cookies, by the leading cookies being allowed to move at a slower pace and the trailing cookies being urged by the conveyor belts to catch up with the leading cookies. The horizontal forces applied by the abutting to one another tend to damage the cookies. Therefore, it is desirable to maintain the vertical edge standing orientation of the cookies in a relatively short horizontal distance along the path of travel of the cookies to minimize damage to the cookies. Typically, the disclosed system maintains the cookies in their vertical edge standing orientation only between 12 and 24 inches from the delivery end of the stacking conveyor system.

In the meantime, as the cookies are being arranged in an edge-standing horizontal stack, cookie trays are individually picked from a nest of trays and placed on a surface conveyor which runs at a right angle with respect to the line of on-coming cookies. A detector is positioned along the tray conveyor adjacent the cookies loader of the apparatus and detects the presence and position of each cookie tray so as to assure that a cookie tray is properly positioned at the delivery end of the line of cookies.

A gate is positioned at the delivery end of the series of stacking conveyors and the gate includes a pair of separator blades that move downwardly in between adjacent ones of the cookies after a certain number of cookies have been counted by a pair of laser detectors, and one of the blades halts the on-coming cookies while the other blade urges the previous slug of cookies onto the cookie loader, so as to form a gap between the divided group or slug of cookies and the on-coming cookies. When the slug of cookies has been deposited onto the awaiting loader and the loader deposits the cookies into the cavity of a cookie tray, the separator blades withdraw from the line of cookies so as to permit the line of cookies to resume movement onto the loader. The loader of the system receives the edge standing cookies and deposits the cookies in the loading trays without reorienting the cookies.

Thus it is an object of this invention to provide a method and apparatus for automatically loading a predetermined number of cookies or similar objects in edge-standing horizontal stacks into trays at a high speed, in a reliable loading operation without substantial risk of damage to the objects, with the objects properly oriented with respect to one another in the trays.

Another object of this invention is to provide a loading method and apparatus for continuously receiving a line of cookies or the like of substantially uniform but irregular shape in a spaced, horizontal, as-baked attitude and reorienting the cookies in a shingle stacked, edge standing attitude for loading the cookies into a tray with the cookies being properly oriented with one another in the cookie tray.

Another object of this invention is to provide an improved cookie loading system which includes means for measuring the height, thickness and rate of movement of shingle stacked cookies and for counting the cookies as the cookies proceed on a surface conveyor system toward a loader, comparing the height of the shingle stacked cookies measured to a pre-set value of the desired height of the shingle stack, and automatically adjusting the speed of the surface conveyor system in response to the detected height and number of the cookies so as to control the angles of the cookies in the shingle stack and to orient the cookies to the desired vertical edge standing attitude as the cookies approach a loading station.

Another object of this invention is to provide a means of detecting the presence of and positions of unfilled trays as the trays are moved on a surface conveyor system toward a loader and controlling the proper placement of the trays for loading cookies or the like from the loader.

Another object of this invention is to provide an improved method and apparatus for controlling the attitude and velocities of movement of a series of cookies or the like as the cookies are moved to a loader and into trays in edge standing attitude.

Other objects, features and advantages of the present invention will become apparent upon reading the following specification, when taken in conjunction with the accompanying drawings.

DETAILED DESCRIPTION

Figure 1:
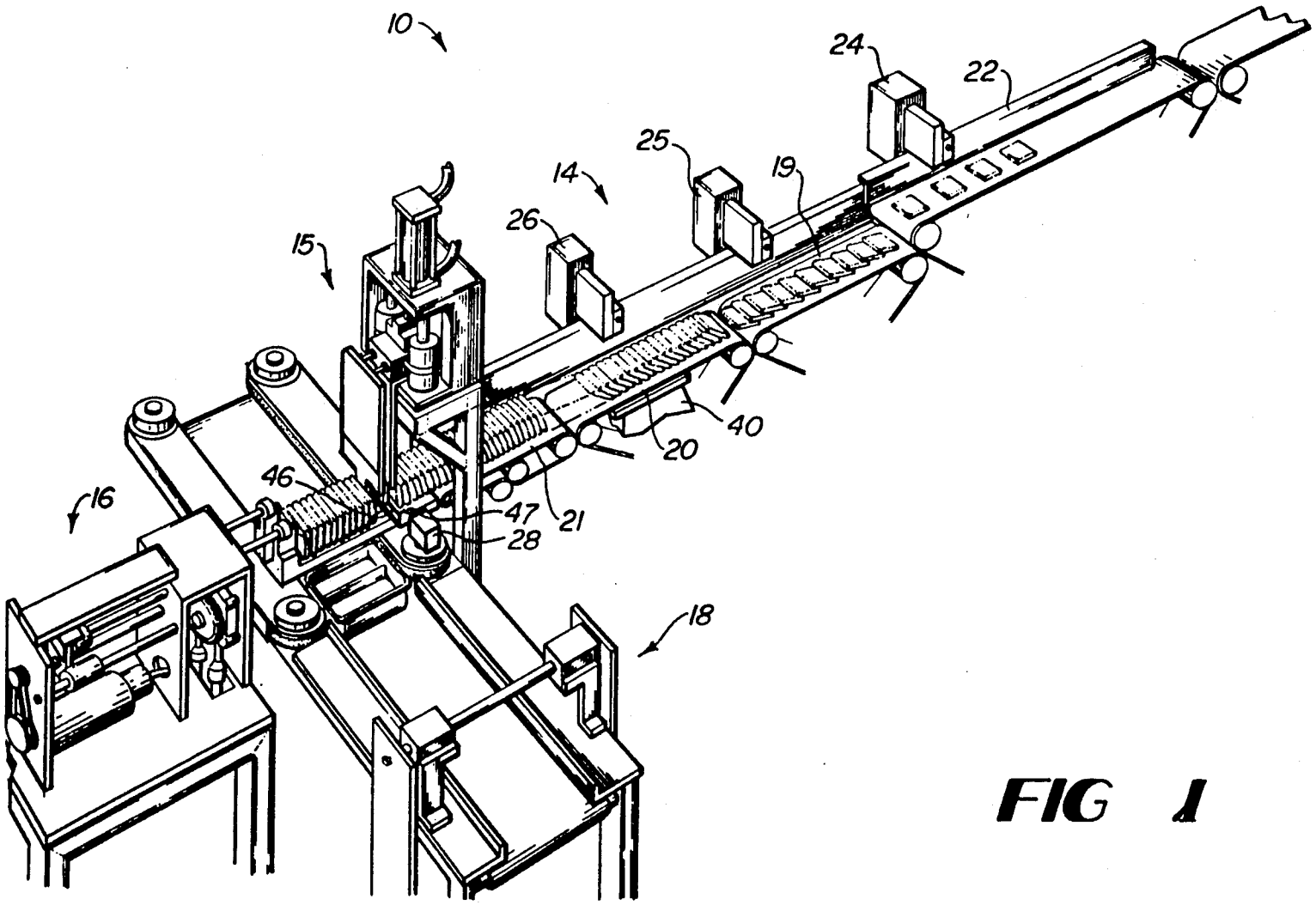
FIG. 1 is a schematic perspective view of the on edge cookie loader.

Referring now in more detail to the drawings, in which like numerals indicate like parts throughout the several views, FIG. 1 illustrates the loading system 10 in schematic form which receives cookies in series from a cookie oven (not shown) and a cooler (not shown) and other equipment such as an enrober (not shown). Typically the cookies are moved on conveyor tapes through the oven and subsequent equipment, with as many as 16 to 30 conveyor lines moving simultaneously through one baking system. As many as 4 conveyor lines are combined (not shown) after the conveyor lines emerge from the oven, enrober, cooler, etc., so that the speed of movement of the cookies on the conveyor system is increased as the cookies approach the loading system.

Loading system 10 includes stacking conveyor system 14, gate 15, loader 16 and tray conveyor 18.

Stacking conveyor system 14 includes three conveyors 19, 20 and 21, with first conveyor 19 receiving cookies from infeed conveyor 22 and delivering cookies to second conveyor 20, with second conveyor 20 delivering cookies to third conveyor 21. The conveyors 19-22 are all surface conveyors, specifically belt conveyors, with the conveyors being aligned with one another so as to form a continuous stream of cookies moving toward the gate 15.

Each of the stacking conveyors 19-21 are driven by variable speed electric motors (not shown). A triple beam sensor 24 is positioned over the delivery end of infeed conveyor 22, and detects the presence of cookies on the infeed conveyor 22 to insure that a continuous line of cookies is moving toward the loading system 10. Cookie sensors 25 and 26 are positioned above each of the surface conveyors 19, 20 and 21 of the stacking conveyor system 14. Specifically, sensor 25 is positioned over the delivery end of the first stacking conveyor 19, while sensor 26 is positioned over the delivery end of second stacking conveyor 20. A pair of counting sensors 28 are positioned adjacent the delivery end of third stacking conveyor 21 on opposite sides of the delivering end of the third stacking conveyor 21. Cookie sensors 25 and 26 are laser detectors of the type commercially available as Aramat Laser Detector, Class 1A with a range of about 100 millimeters. The lasers detect not only the presence of each cookie as it passes on the conveyor system, but also detects the range between the laser and the top surface of the cookie, thereby detecting the height of the cookies as they move on the conveyor system.

The counting sensors 28 at the delivery end of third surface conveyor 21 also are laser detectors but are commercially available as a Aramat Class 3B Laser Detector with a range of about 40 millimeters. Two counting sensors 28 are used in order to double-check one another; as each sensor individually counts cookies, the number of cookies counted by each sensor 28 is compared to ensure that the correct number of cookies has been counted. If a cookies is chipped or broken at one side edge, the sensor 28 adjacent that edge could fail to detect that cookie, but the other counting sensor 28 on the opposite side of the stack of cookies will count that cookie so that the number of cookies to be loaded is thus accurately determined. The sensors communicate with a computer (not shown) which controls the operation of the loading system.

Typically, the cookies are of a non-circular perimeter shape, being somewhat rectangular, and sometimes having a specific shape of a cartoon character or other design formed thereon. Usually, the cookies are all of uniform perimeter shape, even though they are of irregular perimeter shape. As FIG. 1 illustrates, when the cookies are deposited on the infeed conveyor 22, the cookies usually are oriented such that the lengths of the cookies extend cross-wise of the conveyor tape, with the shorter widths of the cookies extending along the conveyor tape. However, the cookies can be handled by the system with their lengths extending along the lengths of the conveyor system, if desired.

Figure 2:
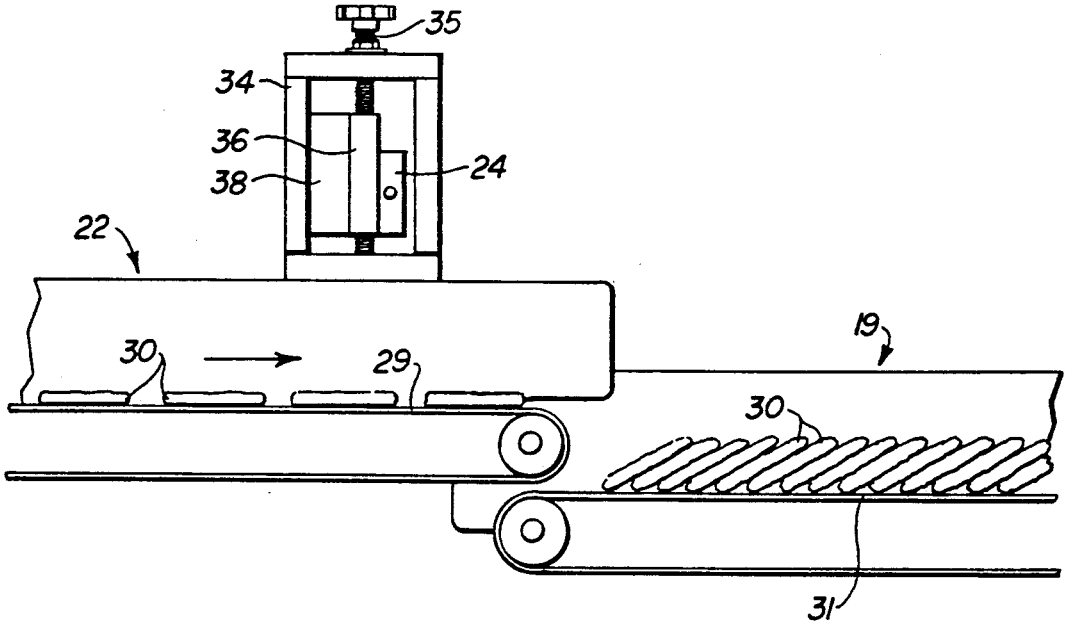
FIG. 2 is a side elevational view of the adjacent ends of the first and second stacking conveyors of the stacking section of the cookie loader and of the laser detector which detects the presence of the cookies on the infeed conveyor.

As illustrated in FIG. 2, the cookies 30 travel on the surface conveyor belt 29 on the infeed conveyor 22 toward the first stacking conveyor 19. The conveyor belt 29 of the infeed conveyor 22 is at a higher level than the upper flight of the conveyor belt 31 of the first stacking conveyor 19, with there being typically about a 1½ inch drop from the infeed conveyor 22 to the first stacking conveyor 19.

Sensor 24 is mounted in a bracket 34 above the upper flight of conveyor belt 29 of last infeed conveyor 22, directly over the path of the cookies 30 as the cookies move to the delivery end of the infeed conveyor. The sensor 24 is adjusted so as to detect the change in height that appears on the conveyor belt when a cookie moves beneath the sensor, thereby sensing or detecting the presence of each cookie 30 moving beneath the sensor 24. The position of the sensor is adjustable by means of the adjusting screw 35 that extends through the bracket 34 into the support block 36 of the bracket. A slide block 38 is also slidably mounted in the bracket 34 so as to stabilize the sensor 24 with respect to its horizontal movement and to permit vertical movement of the sensor 24 with respect to the conveyor tape 29.

Similar brackets are used for the other sensors 25 and 26 (FIG. 1), so that the sensors will be adjustably located along the path of the cookies through the system.

The conveyor belt 31 of the first stacking conveyor 19 is operated at a velocity substantially less than the velocity of the conveyor belt 29 of the infeed conveyor belt 22. For example, the cookies are transported at the rate of between 350 and 450 cookies per minute on each infeed conveyor belt and those infeed conveyor belts deliver their cookies to the infeed conveyor belt 22. Infeed conveyor belt 22 usually operates at a surface velocity of between 40 and 50 feet per minute so as to move the cookies away from the oven area at a rapid rate. First stacking conveyor 19 is operated at a surface speed that corresponds to the rate at which the cookies are received from the infeed conveyor, usually between 15 and 20 feet per minute, allowing the cookies 30 (FIG. 2), received from the infeed conveyor belt 22 to partially overrun the preceding cookie that was deposited on the first stacking conveyor 19. This causes the cookies to be arranged in a shingle stack or sloped, edge standing attitude as the cookies progress on further toward the gate 15 (FIG. 2). The speed of the drive motor (not shown) for the first stacking conveyor 19 is regulated by the information detected by the preceding triple beam sensor 24, so as to speed up and slow down the first stacking conveyor in response to the rate at which the cookies move on the infeed conveyor 22, so as to always assure that there is a shingle stack of cookies being formed on the first stacking conveyor 19.

If a gap in the line of cookies is detected by triple beam sensor 24, the control system deactivates the stacking conveyor system, thereby halting the movement of cookies through the gate 15 and maintaining the shingle stack of cookies at the entrance of first stacking conveyor 19. When the movement of cookies resumes on the infeed conveyor 22 and is detected by the triple beam sensor 24, the operation of the stacking conveyor will resume. By this arrangement the shingle stack of cookies will not be lost if the feeding of the cookies from the infeed conveyor is erratic. The second and third stacking conveyors 20 and 21 are located at the same level as the first stacking conveyor 19, and operate at progressively lower surface speeds. The surface speeds of the second and third stacking conveyors 20 and 21 are regulated by speed of the preceding stacking conveyor, by the actual height of the stack of cookies measured by the cookies sensors 25 and 26, and by the pre-programed percentage of stacking weight of the cookies.

As the cookies on the first stacking conveyor 19 move over the delivery end of that conveyor and toward the next conveyor 20, those cookies are detected by laser detector 25. Laser detector 25 is used to detect the heights of each cookie as each cookie approaches the second stacking conveyor 20. This information is used to control the variable speed motor (not shown) that drives second stacking conveyor 20, so that to assure that the cookies in their shingle stacked attitude are at the proper angle of incline on the second stacking conveyor 20. For example, if a 65–70% stack is desired when the cookies are on the second stacking conveyor 20, the actual height of the stack, as measured by sensor 25, is compared to this pre-programmed desired value and the speed of the second and third stacking conveyors 20 and 21 are increased or decreased with respect to the speed of the first stacking conveyor 19 to lower or raise the height of the stack as desired.

As the cookies make the transition from first stacking conveyor 19 to second stacking conveyor 20, the slower moving belt of the second stacking conveyor will cause the more rapidly on-coming cookies from the first stacking conveyor to be urged to a more upright attitude. This same reorientation of the cookies occurs as the cookies make the transition from the second stacking conveyor 20 to the third stacking conveyor 21, so that as the cookies move onto the third stacking conveyor 21 they are reoriented to an almost upright, side edge standing attitude.

As shown in FIG. 1, a vibrator plate 40 is mounted beneath the conveyor belt 32 of the second stacking conveyor 20, in contact with the lower surface of belt 32. The vibrator plate 40 vibrates back and forth so as to shake the conveyor belt 32 and the cookies stacked on belt 32, causing any cookies which are adhered to one another to become unstuck so that the upper edges of the cookies in the edge standing stack become substantially even.

Figure 3:
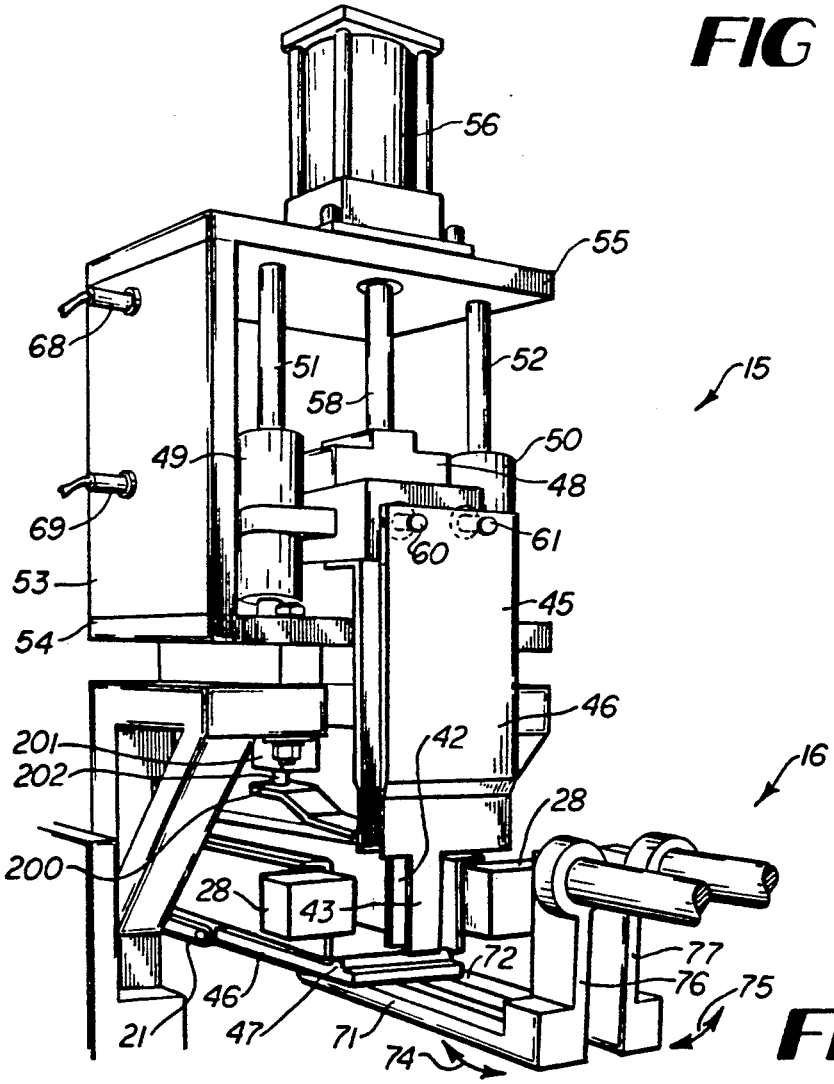
FIG. 3 is a perspective illustration of the loading end of the cookie conveyor system showing the relation of the blades of the separator and the loading arms of the loader.

As illustrated in FIG. 3, gate 15 comprises a pair of reciprocatable separator blades 42 and 43 that move vertically into and out of the path of the cookies as the cookies move beneath the gate 15 above the cookies. Each blade 42 and 43 is supported by a rectangular blade support 44 and 45.

Figure 4:
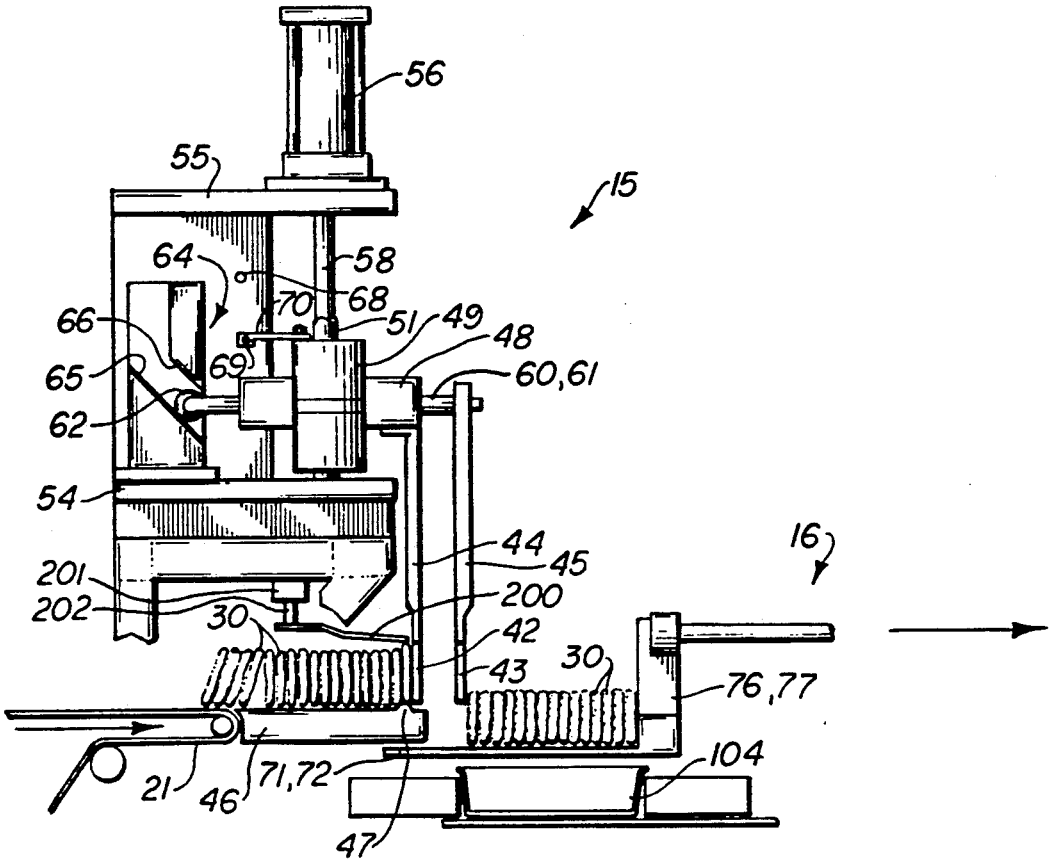
FIG. 4 is a side elevational view of the separator blades in operation to separate the cookies on the conveyor from the cookies on the loading arms.

As shown in FIGS. 1, 3 and 4, a stacking plate 46 is mounted beneath the gate 15 in edge abutment with the delivery end of the third stacking conveyor 21. The stacking plate 46 includes a humped portion 47 at the discharge end, positioned directly below the separator blades 42 and 43. As the cookies pass along the surface of separator plate 46 and over the humped portion 47, they are fanned apart to thus form a gap between adjacent cookies to facilitate the insertion of the separator blades 42 and 43 between the cookies. The two counting sensors 28 are positioned at the gate 15 on opposite sides of the path of the cookies, adjacent the delivery end of stacking plate 46. The laser detectors 28 count the cookies moving on the third stacking plate 46 through the gate 15, using a comparison method, just as the cookies move over the humped portion 47 of stacking plate 46 and beneath the separator blades 42 and 43.

The inner separator blade 42 and its rectangular blade support 44 are mounted at the upper end of rectangular blade support 44 to slide block 48. Slide block 48 has vertically oriented bearings 49 and 50 mounted to its sides, with the bearings 49 and 50 being slidably mounted about vertical guide rods 51 and 52. Vertical guide rods are secured at their lower and upper ends to lower and upper horizontal support plates 54 and 55. Pneumatic cylinder 56 is mounted to upper support plate 55 and its cylinder rod 58 is connected to slide block 48, so as to impart vertical motion to the slide block.

As illustrated in FIG. 4, the forward separator blade 43 and its rectangular blade support 45 are mounted on the ends of a pair of parallel cam shafts 60 and 61, and the cam shafts 60 and 61 extend horizontally through slide block 48, protruding from the other end of the slide block. The other ends of the cam shafts 60 and 61 have a cam roller 62 mounted thereto, with the cam roller 62 located within the confines of a box cam 64. Box cam 64 has a lower cam surface 65 and an upper cam surface 66, with the cam surfaces sloping downwardly from left to right. The arrangement of box cam 64 and cam roller 62 is such that when the cylinder 55 lifts slide block 48, cam roller 62 engages the upper sloped cam surface 66, so that the cam surface 66 pushes the cam roller to the left (FIG. 4), thereby retracting cam shafts 60 and 61 and moving separator blade 43 to the left to a position where it is juxtaposed separator blade 42. When cylinder 54 distends its cylinder rod 58 to move slide block 40 downwardly, cam roller 62 engages the upper surface of cam surface 65 which urges the cam shafts 60 and 61 through the slide block 48 to the right (FIG. 4), thereby causing the separator blade 43 to move to the right away from separator blade 42.

When the separator blades are reciprocated and spread and retracted as described above, the separator blades 42 and 43 move downwardly at first with the blades juxtaposed, so that the blades will enter the line of cookies 30 with the blades in abutment with each other. With this arrangement, the blades will enter the space between adjacent ones of the cookies as the cookies pass over and are fanned apart by the humped portion 47 of the stacking plate 46. As the blades move further downwardly, the blades will become spread apart so as to separate the cookies in the manner as illustrated in FIG. 4. In the meantime, the laser sensors 28 count the cookies and in response to this count, the computer control system (not shown) actuates the cylinder 56 when a predetermined number of the cookies has been counted so that the blades 42 and 43 will properly enter the line of cookies at a position between adjacent ones of the cookies.

A cookie clamping bar 200, comprising an elongated approximately S-shaped stainless steel spring member is lowered into engagement with the top surface of the cookies passing over the humped portion 47 of the stacking plate 46 as the separator blades 42 and 43 are passing into the line of cookies. A pneumatic air cylinder 201 is mounted to a lower surface of lower horizontal support plate 54 and has a piston rod 202 attached to one end of the clamping bar 200. The air cylinder 201 is actuated by the same signal from the computer that activates cylinder 56 to cause the downward vertical motion of the separator blades 42 and 43 and lowers the clamping bar 200 into slight compression contact with the top surface of the foremost cookies of the stack of cookies following the slug of cookies to be loaded. The clamping bar 200 lightly compresses the cookies approximately ⅛" in order to hold the cookies in place and prevent them from falling forwardly as the separator blades 42 and 43 move into the line of cookies.

As illustrated in FIG. 3, proximity sensors 68 and 69 are mounted in the vertical support 53 of gate 15 and extend through the vertical support. A flag 70 (FIG. 4)

is mounted to slide block 49 and moves with the slide block. The flag 70 is located so that it will register with the proximity sensors 68 and 69. When the flag registers with a sensor 68 or 69, a detection is made that the slide block is in either its up position or its down position. This allows the control system to know the location of the separator blades 42 and 43, assuring that the blades are either in their up or down position where they belong, and not in some intermediate position where the operation of the system will be interfered with.

Figure 6:
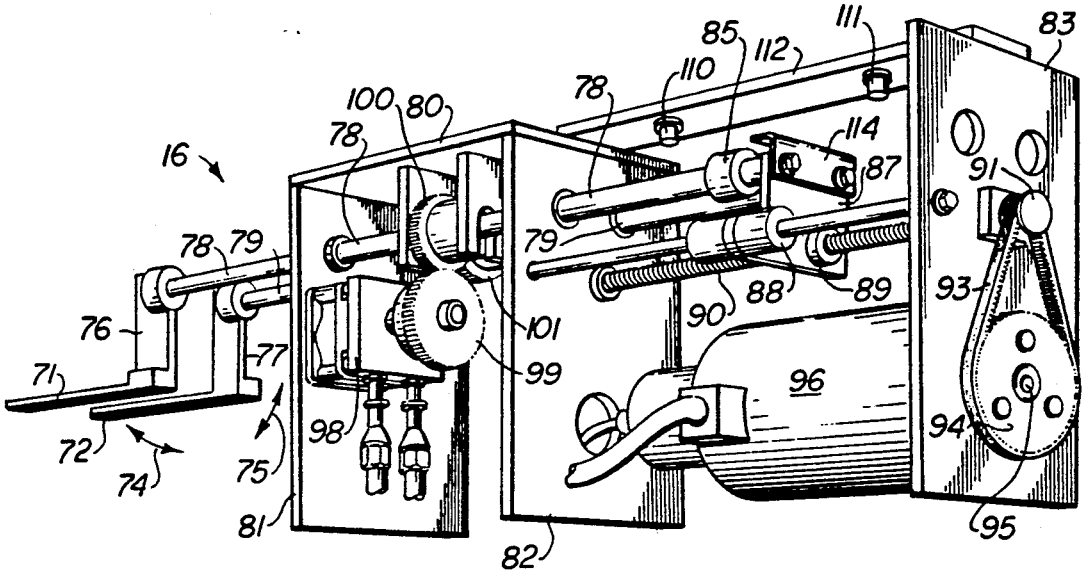
FIG. 6 is a perspective illustration of the drive system for the loader.

As illustrated in FIGS. 4 and 6, cookie loader 16 is positioned adjacent gate 15 for receiving the cookies passing through the gate and for depositing the cookies in an awaiting cookie tray. Cookies loader 16 includes a pair of horizontally extending parallel cookie receiving arms 71 and 72 that reach beneath the discharge end of stacking plate 46 so as to receive the cookies as they pass through the gate 15. The cookie receiving arms 71 and 72 are arranged so as to swing in opposite directions through arcs, as illustrated by arrows 74 and 75. Each cookie receiving arm 71 and 72 is mounted at one end to an upright arm 76 and 77, respectively, and each arm 76 and 77 is mounted to a rotatable and reciprocatable control shaft 78, 79, respectively.

As illustrated in FIG. 6, control shafts 78 and 79 extend through the front wall 81 and internal partition 82 and toward rear wall 83 of housing 80, with the distal end of shafts 78, 79 mounted in bearings 85 (only one shown). The bearings are mounted to bearing support block 87, and bearing support block is mounted to side bearing 88 and travel screw follower 89. Travel screw follower 89 is mounted about travel screw 90. Travel screw 90 is mounted at its ends to partition 82 and to rear wall 83, extending through the rear wall, with a sheave 91 mounting on the protruding end. Sheave 91 is connected by timing belt 93 to motor sheave 94, and motor sheave 94 is connected by drive shaft 95 to motor 96. Motor 96 is a variable speed reversible motor which functions to rotate travel screw 90. When travel screw 90 is rotated, it reciprocates control shafts 78 and 79 of cookie receiving arms 71 and 72 toward and away from gate 15, so that the cookie receiving arms reciprocate partially beneath the stacking plate 46. When moved away from the gate 15, the cookie receiving arms 71 and 72 progressively receive cookies moving through the gate, with the cookies being stacked vertically against the upright arms 76 and 77 of the loader 16.

Rotary actuator 98 is located in shaft control housing 80 and its drive gear 99 meshes with driven gear 100 which is mounted to control shaft 78. A similar driven gear 101 is mounted to control shaft 79, and meshes with driven gear 100. Driven gears 100 and 101 are slidably but non-rotatably mounted to their respective control shafts 78 and 79, with the shafts being slidable through driven gears 100 and 101 so that the shafts can reciprocate longitudinally through those gears, but the control shafts 78 and 79 and driven gears 100 and 101 are keyed to each other so that the driven gears 100 and 101 and control shafts 78 and 79 rotate together. With this arrangement, when the rotary actuator 98 rotates its drive gear 99, the driven gears 100 and 101 will also be rotated, but in opposite directions of rotation with respect to each other. This causes cookie receiving arms 71 and 72 to oscillate in opposite directions as indicated by arrows 74 and 75.

Figure 7A:
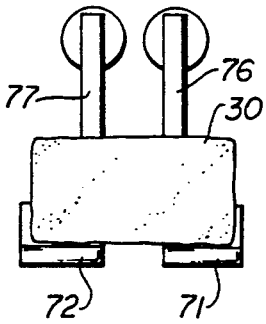
FIG. 7A is an end view showing the bottom surface of the leading cookie in a slug of edge-standing cookies, with the slug resting on the loading arms of the loader.
Figure 7B:
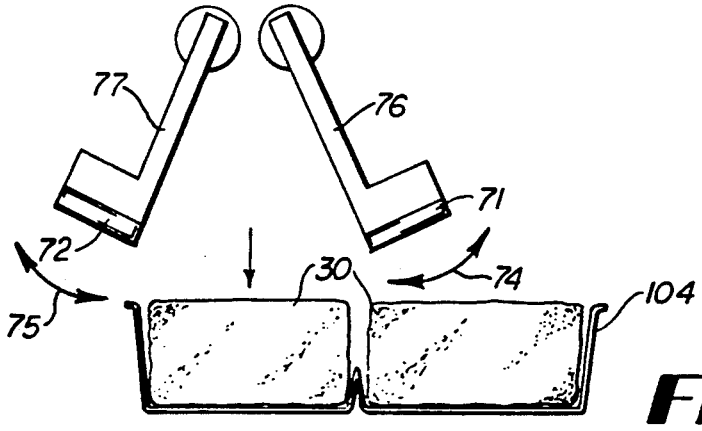
FIG. 7B is an end view similar to FIG. 8 but showing how the cookies are loaded into a cookie tray by the loading arms.

The cookie receiving arms 71 and 72 will be held closely adjacent each other as illustrated in FIG. 7A so as to receive cookies 30 through the gate 15. As the cookies accumulate on the receiving arms and as the receiving arms are progressively withdrawn from beneath the gate by the rotation of the travel screw 90 (FIG. 6), the cookies come to rest in a vertical side edge standing attitude, with the first cookie leaning against the upright arms 76, 77 of the loader 16 (FIG. 7A) and the other cookies each leaning against a preceding cookie, until the predetermined number of cookies has been accumulated on the cookie receiving arm. At this point, the slug or group of cookies is located above an awaiting cookie tray 104 and motor 98 (FIG. 6) tilts the cookie receiving arms as illustrated in FIG. 7B, so that the cookie receiving arms 71 and 72 slide out from beneath the cookies and the cookies are dropped vertically in their edge standing attitude into a cavity of the cookie tray 104.

As illustrated in FIG. 6, proximity switches 110 and 111 are mounted in the top wall 112 of the shaft control housing 80. A flag 114 is mounted to bearing support block 87 and located so as to move closely adjacent proximity switches 110 and 111. With this arrangement, when cookie receiving arms 71 and 72 are positioned all the way toward gate 16 or all the way away from gate 16, a signal will be emitted from one or the other of proximity switches 110 or 111, thereby indicating to the computer control system that the cookie receiving arms are properly located. These signals generated by sensors 110 and 111 indicate the distance the receiving arms 71 and 72 are moved during the first several loading operations and transmit those values to the computer control system. From these distances, an average loading distance is determined by the computer to find a fully loaded, "home" position of the receiving arms 71 and 72. After this home position has been determined and set by the computer, the sensors 110 and 111 are used as emergency stop switches to stop the movement of the receiving arms 71 and 72 past their home position. The sensors 110 and 111 thus function as a backup for the counting sensors 28. If the counting sensors 28 malfunction and miscount the number of cookies to be loaded, sensors 110 and 111 will allow the receiving arms 71 and 72 to move only a limited distance, corresponding to the volume of cookies to be loaded by the receiving arms 71 and 72, before the movement of the receiving arms 71 and 72 is halted and the cookies thereon dumped into a cookie tray 104.

Figure 8:
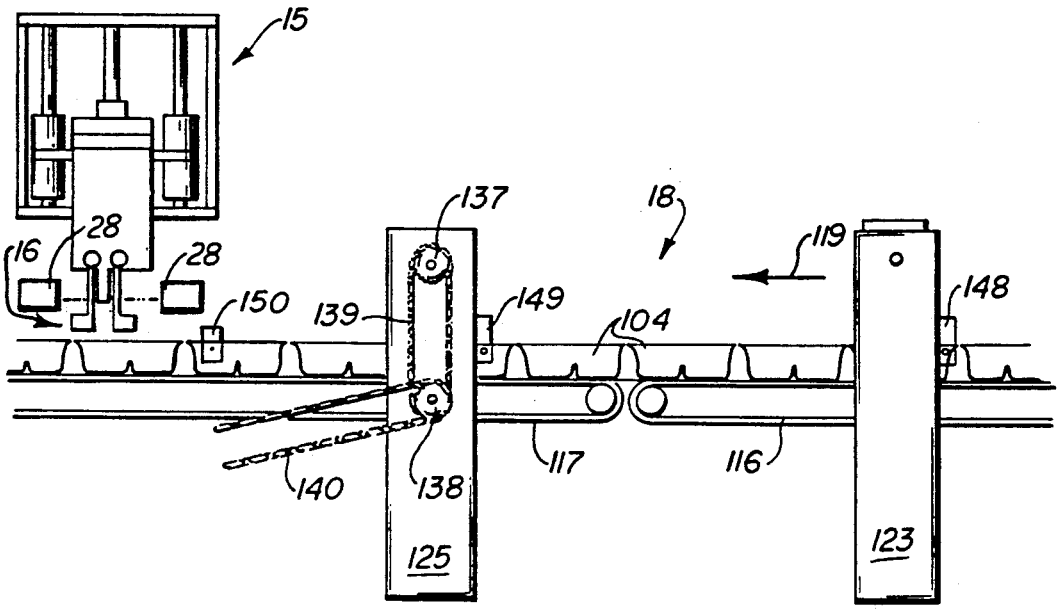
FIG. 8 is a side elevational view of the cookie tray conveyor showing the movement of cookie trays along the conveyor toward a position under the loading arms of the loader and the laser sensors which regulate the movements of the tray conveyor.
Figure 9:
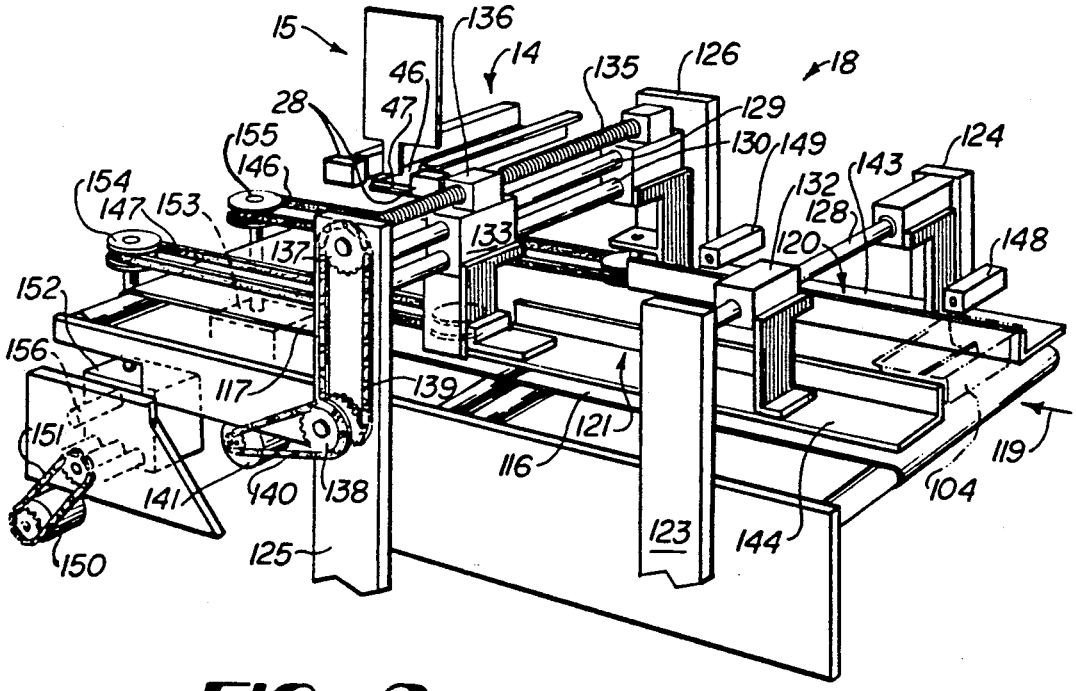
FIG. 9 is a perspective illustration of the tray conveyor.

As illustrated in FIGS. 8 and 9, tray conveyor 18 is arranged to supply a continuous series of cookie trays 104 to the gate area just beneath the gate 15 of the stacking conveyor system 14. A pair of belt conveyors 116 and 117 extend at an angle normal to the path of movement of the cookies and at a level below the path of the cookies, so as to move the cookie trays 104 in the direction as indicated by arrows 119. First conveyor belt 116 is fabricated so as to have a relatively slick conveying surface, whereas the second conveying belt 117 is fabricated so as to have a more tacky surface. Side guides 120 and 121 are suspended above the conveyor belts 116 and 117 so as to guide the cookie trays 104 on the conveyor belt. Support stanchions 123, 124, 125 and 126 support the side guides above the conveyor belts. Horizontal support bar 128 is supported at its ends by the upper end portions of stanchions 123 and 124, and similar horizontal support bars 129 and 130 are mounted at their ends to stanchions 125 and 126. Slide blocks 132 and 133 are slidably mounted to the horizontal support bars 128-130. Slide blocks 132 and 133 support side guide 121 over the conveyor belts 116 and 117. Travel screw 135 is also supported at its ends at the upper end portions of stanchions 125 and 126, and travel screw 135 is threadably received in follower 136, with follower 136 being mounted to slide block 133. Sheaves 137 and 138 and their belts 139 and 140 transmit rotary movement from a drive motor 141 or mechanical crank (not shown) to the travel screw 135, so as to adjust the position of the side guide 121. This increases or decreases the space between side guides 120 and 121, so as to accommodate larger or smaller cookie trays 104.

As shown in FIG. 9, side guides 120 and 121 comprised substantially "Z-shaped" rails 143 and 144 which extend over the first conveyor belt 116 and partially over the second conveyor belt 117, and have top portions 145 which overhang the upper edges of the cookies trays 104 to prevent the cookies trays 104 from popping up and away from the tray conveyor 18 or becoming jammed together on the tray conveyor 18. However, in the vicinity of gate 15, the side guides 120 and 121 are formed as side conveyor belts 146 and 147.

The side conveyor belts tend to positively grip the adjacent edges of the cookie tray 104 and positively move the cookie tray to and then beyond the drop area beneath gate 15 and the loader 16. In the meantime, a de-nester or picker (not shown) picks cookie trays 104 from a nested stack and places the cookie trays on the first slick conveyor 116 which operates at a higher speed than the second conveyor 117. The cookie trays 104 are moved rapidly on the first conveyor 116 until they abut a preceding cookie tray, whereupon the cookie trays will be accumulated in a que of trays as the conveyor belt 116 continuously moves there beneath so as to bring on subsequent cookie trays. A first photocell 148 detects when the cookie tray is absent at the entry end of the tray conveyor 18 and continues the action of the de-nester until a cookie tray remains at the entry end of the tray conveyor 18 at the photocell.

As the cookie trays 104 progress on through the tray conveyor, a second photocell 149 functions as a "no-tray detector" and detects the presence of each cookie tray. Should photocell 149 detect a gap in the line of cookie trays, a warning will be given, i.e. a warning light is illuminated and/or sound alarm is activated.

However, loading will continue until the last cookies tray 104 on the tray conveyor 18 has been filled, at which time if photocell 149 still reads a gap in the line of cookies trays, the entire system will be shut down until the gap is omitted. Other photocells can be used in like manner along the path 119 of the cookie trays 104 through the tray conveyor 18 so as to control the proper placement of the cookie trays.

A third photocell 150 is located in the next to last position of a cookie tray prior to the cookie tray being located directly beneath the loader 16 approximately one tray away from the loader 16 and detects the incoming edges of the cookie tray, particularly the height of the side edges and the middle divider of each cookie tray, and marks the exact position of the cookie tray as it progresses toward the loader 16. Should a gap between the cookie trays be discovered by the laser detector 150, the operation of the system will be terminated after the last tray 104 is filled if there is still a gap. At the same time, the tray conveyor 18 indexes forwardly until the gap is eliminated.

Side conveyor belts 146 and 147 are driven by motor 150, timing belt 151, first and second gear boxes 152 and 153 and driven sheaves 154 and 155. Gear boxes 152 and 153 are connected together by a horizontal pitman 156. Gear box 152 is movable with side guide 121 so as to bring the side conveyor belt 147 closer to or further away from the opposite side conveyor belt 146.

The entire tray conveyor 18 is raised and lowered to the correct height to position the cookie trays 104 at the proper height for receiving a slug of cookies by an adjustment mechanism (not shown) controlled by the computer control system. Values for the size of the cookies and the height of the cookie trays 104 are programmed into the computer, which accordingly raises or lowers the tray conveyor 18 with respect to the cookie loader 16 to raise or lower the cookie trays 104 to the proper height for loading the cookies into the cookie trays 104.

OPERATION

When the on edge cookie loader 10 is in operation, pre-determined values for the height of the cookies, stacking height desire, size of cookie trays and the number of cookies to be loaded in each tray cavity, are all pre-programmed into the computer control system of the on edge cookie loader 10 by an operator. Cookies 30 are received from the infeed conveyor 22 onto the stacking conveyors 19, 20 and 21 of the stacking conveyor system 14. As the cookies are delivered by the infeed conveyor 22, a triple sensor 24 detects each cookie as it makes the transition to the first stacking conveyor 19. The last infeed conveyor belt 22 operates at a speed of from about 40 to 50 feet per minute, whereas the first stacking conveyor 19 operates at a slower speed, from about 15 to 20 feet per minute. The speed of stacking conveyor 19 is determined by the rate at which the cookies move on the infeed conveyor 22, as determined by the triple beam 24. Since the first stacking conveyor 19 is slower than the infeed conveyor 22, the cookies will make the transition to the first stacking conveyor 19 by partially overrunning one another so as to form a shallow shingle stack of cookies (FIG. 2). The triple beam sensor 24 will make sure that a cookie 30 is being transferred in proper timed relationship with respect to the first stacking conveyor 19.

If a cookie is not available on the last infeed conveyor 22 so that there is a blank space in the line of cookies, the stacking system will be shut down until a cookie becomes available. With this arrangement, the shingle stack relationship of the cookies always will be maintained on the first stacking conveyor 19.

As the cookies make the transition to the second stacking conveyor 20, a laser detector 25 detects the height of the stack of cookies at the delivery end of the first stacking conveyor 19. This information controls the speed of the second and third stacking conveyor 20 and 21 and the feed gate 15. For example, the second stacking conveyor typically operates at a rate of 10 to 15 feet per minute, which is about ⅔ of the speed of the first stacking conveyor. This causes the cookies received in a shingle stack, side edge standing relationship from the first stacking conveyor 19 to be increased in height, by tilting the cookies more upright. This happens because the cookies on the second stacking conveyor 20 are moving at a slower pace than those received from the first stacking conveyor 19. In general, it is recommended that the single stack of cookies on the second stacking conveyor be within a range of 65–70% vertically aligned. If not within this desired range, the computer control system will automatically adjust the speed of the second and third stacking conveyors 20 and 21 in response to the readings made by sensor 25, to raise and lower the height of the stack of cookies.

Likewise, as the cookies make the transition from second stacking conveyor 20 to third stacking conveyor 21, a laser detector 26 again measures the height of the edge standing cookies and controls the speed of third stacking conveyor 21 and the feed gate 15. For example, third stacking conveyor 21 typically operates at a speed of between 6 and 10 feet per minute. Again, the edge standing cookies tend to become more upright as they move from the faster moving conveyor 20 to the slower moving conveyor 21 so that the stack of cookies will be 100% vertical.

Figure 5:
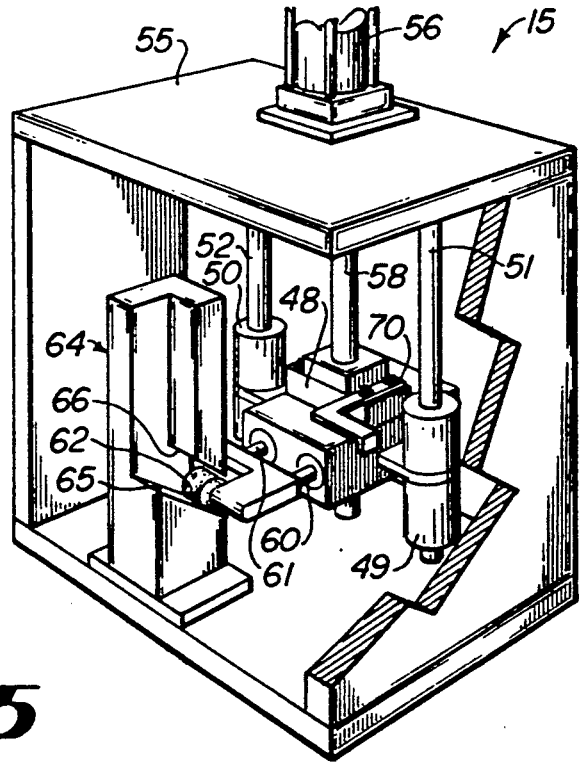
FIG. 5 is a perspective view of the cam assembly of the separator.

As the cookies approach gate 15 (FIGS. 3, 4 and 5) they pass over the humped portion 47 of the stacking plate 46, causing the cookies to fan apart to form a gap between the cookies for the insertion of the separator blades 42 and 43 of the gate 15. The pair of laser detectors 28 count the cookies and relay this count to the computer which accordingly controls the timing of the operation of gate 15, loader 16 and tray conveyor 18. Counting sensor 28 are located immediately adjacent the upper edges of the cookies at the discharge end of the stacking plate 46 and count the first cookie adjacent the gate, and when the gate is raised, count the cookies moved by the stacking conveyor system on to the gate until a predetermined count has been detected, whereupon the gate is moved downwardly so as to project into the gap between the last counted cookie and the next adjacent cookie. As the next to last cookies of the pre-determined, pre-programmed number of cookies is counted, the stacking conveying system is slowed to enable the counting sensors 28 to count the last cookie and accurately determine the placement of the gap between the last counted cookie.

As illustrated in FIG. 4, the continuous movement of the third stacking conveyor 21 tends to maintain the cookies 30 in an upright attitude and those cookies that are just entering the third stacking conveyor which might be slightly angled away from vertical will be progressively tilted toward an upright attitude by the continuous application of a horizontal force to the lower edges of the cookies by the conveyor belt while the upper portions of the cookies are restrained by the accumulated upright cookies. This tends to allow the third stacking conveyor 21 to perform the last erection of the cookies at the gate while the gate is closed. When the gate opens, there should be an accumulation of upright cookies for a distance between twelve and twenty-four inches leading back upstream from the gate 15. Thus, there should always be a supply of upright cookies at the gate 15.

The separator blades 42 and 43 of gate 15 reciprocate up and down and also move together and apart during the gate opening and closing function. As the blades 42 and 43 begin their downward motion, air cylinder 201 will have been simultaneously actuated and will lower the clamping bar 200 into compression contact with the upper surface of the foremost cookie on the stacking plate 46 adjacent the slug of cookies. The clamping bar 200 holds the cookies on the stacking plate 46 upright as the separator blades 42 and 43 move down between the cookies, preventing the cookies from falling over and jamming or becoming crushed by the blades 42 and 43.

As illustrated in FIG. 4, when the gate is in its down, separating position, the cylinder 56 will have urged the slide block 49 downwardly and the cam roller 62 will have engaged the cam surface 65 so as to distend cam rods 60 and 61, causing the separator blades 42 and 43 to part. This parting of the separator blades occurs in the last portion of the downward movement of the separator blades. As the separator blades enter the line of cookies 30, the blades are together, so that the blades can fit in between adjacent ones of the cookies; however, as the separator blades 42 and 43 move further downwardly, the action of the cam roller 62 and its cam surface 65 causes the blades to separate, thereby continuing the movement of the slug of cookies 30 onto the cookie receiving arms 71 and 72 of the loader 16.

In the meantime, as the cookies move through gate 15 the cookie receiving arms 71, 72 progressively withdraw from beneath the delivery end of third stacking conveyor 21 so that the cookies are received in an edge standing, substantially upright attitude on the cookie receiving arms 71, 72. When the cookies are properly positioned above a cookie tray 104, the cookie receiving arms are tilted out from beneath the slug of cookies (FIG. 7A and 7B) so as to drop the cookies into the cookie tray 104.

In the meantime, cookie trays are progressively cued up and transported by the surface conveyors 116 and 117 until each tray is properly positioned beneath the loader 16. The trays are moved in increments of one cell on each cycle of operation of the loader 16, so that an empty cell will be presented beneath the loader on each cycle of operation of the loader.

While the invention has been disclosed in connection with the loading of cookies into cookie trays, it should be apparent to those skilled in the art that the principles of this invention can be utilized in other environments, such as in the loading of other objects, and the term "cookie" is not to be construed as limiting this invention to the loading of only cookies. Moreover, while three stacking conveyors 19, 20 and 21 have been disclosed, more or fewer stacking conveyors can be utilized in the practice of the disclosed invention.

Further, it will be understood that the foregoing relates only to a preferred embodiment of the present invention, and that numerous changes and modifications may be made therein without departing from the spirit and scope of the invention as set forth in the following claims.

We claim:

1. Apparatus for loading cookies from a delivery end of an infeed surface conveyor extending from an oven into a receptacle, with the cookies having an irregularly shaped perimeter and having lengths greater than their widths, said apparatus comprising:

a first surface conveyor for positioning at the delivery end of the infeed conveyor at a level lower than the delivery end of the infeed conveyor, first speed control means for adjusting the speed of said first surface conveyor in response to the rate at which the cookies are received from the infeed conveyor on the first surface conveyor so that the cookies are received in overlying shingle stacked relationship on said first surface conveyor, at least one second surface conveyor aligned with said first surface conveyor for receiving the shingle stacked cookies from said first surface conveyor, second speed control means for adjusting the speed of said second surface conveyor in response to the height of the shingle stacked cookies on said first surface conveyor so that the cookies are tilted toward an upright attitude as the cookies move from said first surface conveyor to said second surface conveyor, gate means positioned at the delivery end of said second surface conveyor for intermittently closing and halting the movement of the cookies at said gate means and opening and permitting the movement of the cookies through said gate means, sensing means for detecting the number of cookies moved through said gate means and arranged to intermittently open and close said gate means in response to the number of cookies moved through said gate means, a tray conveyor positioned adjacent said gate means for carrying cookie trays in series along a path normal to the direction of movement of the cookies moved through said gate means, and loading means positioned at said gate means, said loading means being responsive to the movement of cookies through said gate means to collect the cookies moved through said gate means and to deposit the cookies in a cookie tray carried by said tray conveyor.

2. The apparatus of claim 1 and wherein said at least one second surface conveyor comprises:

at least two surface conveyors positioned in aligned relationship for receiving the shingle stacked cookies from said first surface conveyor and delivering the cookies to said gate means, and said second speed control means comprising means for adjusting the speeds of said at least two surface conveyors in response to the height of the shingle stacked cookies as the shingle stacked cookies approach each of said at least two surface conveyors.

3. The apparatus of claim 1 and wherein said first and second speed control means each comprise a laser detector, and mounting means adjustably mounting said detectors above the delivery ends of the stacking conveyor and said first surface conveyor for detecting the cookies as the cookies move toward said first and second surface conveyors.

4. The apparatus of claim 1 and wherein said tray conveyor comprises a belt conveyor and control means for controlling the positions of the cookie trays on said belt conveyor.

5. The apparatus of claim 1 and wherein said gate means includes a pair of parallel juxtaposed vertically oriented blades positioned normal to the direction of movement of the cookies through said gate means, gate drive means for reciprocating said blades vertically into and away from the line of cookies at said gate means, and cam means for separating said blades as said blades are moved by said drive means into the line of cookies, so that the cookies that have moved through the gate means are urged by the blades further beyond the gate means and the cookies at the gate are halted and the oncoming cookies are further urged toward an upright edge-standing attitude by said second surface conveyor.

6. The apparatus of claim 1 and further including a means for holding the oncoming cookies in front of the gate in an upright edge standing attitude, comprising a pneumatic cylinder mounted adjacent said gate means and activated by said sensing means simultaneously with said gate means, and a spring member attached to said pneumatic cylinder and moved by said pneumatic cylinder into compression contact with the oncoming cookies to hold the cookies in an edge standing altitude and out of the way of said gate means.

7. A method of loading cookies into cookie trays comprising:

receiving cookies in series on a continuously moving first surface conveyor from a preceding surface conveyor at a level lower than the preceding surface conveyor, adjusting the speed of the first surface conveyor in response to the rate of delivery of cookies to the first surface conveyor so that the cookies are received in partially overlying shingle stacked relationship on the first surface conveyor, delivering the shingle stacked cookies from the first surface conveyor to at least one continuously moving second surface conveyor, controlling the speed of the second surface conveyor in response to the height of the shingle stacked cookies on said first surface conveyor so as to tilt the shingle stacked cookies toward a vertical attitude as the cookies move from the first surface conveyor to the second surface conveyor, moving the shingle stacked cookies with said second surface conveyor through a gate means, intermittently halting the cookies at the gate means after a predetermined number of cookies have passed through the gate means and tilting the oncoming cookies further toward a vertical attitude as the cookies are halted at the gate means, and depositing a predetermined number of the cookies moved through the gate means into a cavity of a cookie tray.

8. In a method of loading cookies into cavities of open top semi-cylindrical cookie trays or the like wherein the cookies are transported on a series of moving surface conveyors toward a loader, the cookies are shingle stacked as the cookies move from one surface conveyor to the next, and the height of the shingle stack is increased as the cookies approach a cookie loader, the improvement therein comprising:

detecting the presence of each of the cookies as the cookies move from a delivery conveyor in an as-baked attitude to a first stacking surface conveyor, in response to the detection adjusting the speed of the first stacking surface conveyor to move at a speed less than the delivery conveyor so that the cookies transferred from the delivery conveyor are received on the first stacking surface conveyor in partially overlying shingle-stacked relationship, detecting the height of the shingle stacked cookies on the first stacking surface conveyor as the cookies move from the first conveyor to a second stacking surface conveyor, in response to the detection of the height of the shingle stacked cookies on the first stacking surface conveyor adjusting the speed of the second stacking surface conveyor to move at a speed less than the first surface conveyor to increase the height of the shingle stacked cookies, counting the cookies as the cookies are delivered from the end of the second stacking surface conveyor to a loader, in response to counting a predetermined number of the cookies halting the movement of the cookies from the end of the second stacking surface conveyor, in response to counting the cookies progressively receiving the cookies on a cookie loader up until the predetermined number of cookies have been counted, and in response to counting a predetermined number of cookies depositing the cookies from the loader to a cavity of a cookie tray.

9. An apparatus for loading cookies, each cookie being of irregular perimeter shape, in a receptacle, comprising:

a surface conveying means having a cookie input end and a cookie delivery end for moving cookies in an edge standing shingle stacked attitude, said conveying means including at least two surface conveyors arranged in succession and operating at successively decreased speeds for raising the cookies from a low shingle-stacked attitude to a higher shingle stacked attitude;

at least two detecting means positioned along said surface conveying means for detecting the height of the cookies as the cookies are raised to a higher edge standing shingle stacked attitude by said conveyors and for controlling the speeds of said surface conveyors;

loading means adjacent the cookie delivery end of said conveying means for loading a predetermined number of cookies into a cookie tray;

a counting means at said cookie loading end of said conveying means for counting a pre-determined number of cookies to be loaded into the tray by said loading means, means for separating the pre-determined number of cookies from the remaining cookies on said conveying means and maintaining the horizontally stacked alignment of the cookies as they are loaded into the tray by said loading means, a cookie tray conveyor arranged perpendicular to said conveying means for moving a cookie tray into position under said loading means, and a tray detecting means adjacent said tray conveyor and adjacent to said cookie delivery end of said surface conveying means for determining the location and position of a cookie tray to ensure proper loading of the cookies into the tray by said loading means.

10. The apparatus of claim 9 wherein said detecting means along said surface conveying means comprises a proximity sensor mounted above the cookies on said conveying means at a position preceding each of said successive surface conveyors for determining the height of the cookies in their edge standing attitude and adjusting the velocity of said surface conveyors following said sensing means to adjust the height of the cookies.

11. The apparatus of claim 9 wherein said loading means comprise a pair of rectilinear arms on which a number of cookies arranged in an edge standing attitude abutting one another are placed for loading into a tray.

12. The apparatus of claim 9 wherein said means for separating a predetermined number of cookies on said loading members from the cookies remaining on said conveying means comprises separating blades movable into and out of the line of cookies for impeding the further forward motion of the cookies remaining on said conveying means, and means for moving one of said separator blades in the direction of movement of the cookies to form a gap in the line of edge standing cookies, and a stacking plate having a raised portion positioned beneath said separating blades for fanning apart the line of cookies as the line of cookies passes over said raised portion of said stacking plate to create a space for the entry of said separating blades into the line of cookies.

13. The apparatus of claim 12 wherein said means for separating a predetermined number of cookies on said loading members from the cookies remaining on said conveying means comprises a sensor mounted above the delivery end of said conveying means for counting the number of cookies being placed on said loading means and, upon the counting of a predetermined number of cookies, signaling said separating means to move downwardly between the last cookie stacked on said loading means and the first cookie remaining on said surface conveyor to separate the cookies.

14. The apparatus as claimed in claim 9 wherein each cookie tray includes at least two sides and a middle rib, and said tray detecting means comprises a sensor mounted adjacent the delivery end of said conveying means over a cookie tray conveyor for detecting the position of the sides and middle rib of each cookie tray to ensure the proper positioning of the cookie tray on said cookie tray conveyor during the loading of the cookie tray by said loading means.

15. Apparatus for loading cookies into a cookie tray comprising at least two aligned surface conveyors for receiving a series of cookies in shingle-stacked relationship and operating at successively decreased velocities and defining a path having a cookie delivery end and along which cookies are raised in a shingle-stacked relationship toward an upright edge standing attitude abutting one another, a cookie loading means adjacent said cookie delivery end of the conveyors for progressively receiving a predetermined number of cookies and loading the predetermined number of cookies from said conveyors into a cookie tray, a height detecting means for detecting the height of the cookies as the cookies are in an edge standing attitude moving along the path and for adjusting the speed of the surface conveyors and ensuring the cookies are substantially upright for loading into a cookie tray by said loading means, and means for counting each of said cookies as each cookie is delivered by said surface conveyors to said loading means and for actuating said loading means.

16. The apparatus as claimed in claim 15 wherein said height detecting means comprises at least two proximity sensors, each sensor positioned at a delivery end of one of said surface conveyors and arranged to adjust the speed of the conveyor next in succession for determining the height of a stack of cookies and adjusting this height by varying the speed of the next succeeding conveyor.

17. The apparatus of claim 15 and wherein said means for counting each of said cookies comprises a sensor mounted above said cookie loading end of the path formed by said surface conveyors for counting a predetermined number of cookies placed upon said cookie loading means and for activating said cookie loading means in response to counting the predetermined number of cookies.

18. Apparatus for loading cookies into a cookie tray comprising at least two aligned surface conveyors having an input end and a cookie delivery end for moving cookies standing on one side edge in horizontal abutment with one another along a path toward the cookie delivery end of said path, at least one height detecting means for reading the height of the cookies and making adjustments to this height by varying the speed of said surface conveyors, a pair of cookie loading members at said cookie delivery end of the path for loading a predetermined number of cookies from the path into a cookie tray, a cookie counting means for counting out the proper number of cookies to be loaded into the tray, and a separating means for separating the cookies on said cookie loading members from those remaining on said surface conveyors upon said sensor counting the proper number of cookies having been placed on said loading members.

19. The apparatus as defined in claim 18 wherein said separating means comprises a pair of separator blades vertically movable downwardly between adjacent cookies upon the counting of a predetermined number of cookies by said cookie counter, one of said separator blades remaining in stationary contact with the front surface of the foremost cookie remaining on said surface conveyor path for prohibiting forward movement of the cookies on said surface conveyor path, while said other separator blade is movable laterally to abut the rear surface of the rearmost cookie of the stack of cookies on said loading members for maintaining the stacked alignment of the cookies in an edge standing vertical attitude for loading by said loading members into a cookie tray.

20. Apparatus for loading cookies into a cookie tray comprising a surface conveying means having an input end and a delivery end for receiving a series of shingle stacked cookies and moving the cookies in horizontally aligned edge standing abutment with one another along a path toward said delivery end, at least one laser detecting means for detecting the height of the stack of cookies, control means for adjusting the speeds of said surface conveying means down the path in response to the detection of the height of the stack of cookies, cookie loading means at the loading end of said surface conveying means for loading a predetermined number of cookies into a tray, counting means for counting out the predetermined number of cookies placed on said loading members, a separating means responsive to said counting means counting the predetermined number of cookies for separating the stack of cookies remaining on said conveying means from the predetermined number of cookies on said loading means, and a cookie tray conveying means for moving a cookie tray into position for loading by said loading means.

21. The apparatus of claim 20 wherein said cookie tray conveying means comprises a surface conveyor for moving the trays into loading position beneath said loading members, and a pair of guide rails straddling said surface conveyor and adjustable to accommodate different size trays for ensuring proper alignment of the trays as they proceed towards said loading members.

22. The apparatus as defined in claim 20 and further including a proximity detecting means mounted adjacent said cookie tray conveying means for reading the upper surface of the cookie trays on said tray conveying means and ensuring the presence of a cookie tray under said loading members.

23. A method of loading cookies into a cookie receptacle, with the cookies standing on one side edge in the cookie receptacle, comprising:

moving a line of shingle stacked cookies on at least two surface conveyors arranged in succession toward a cookie loading means;

reorienting each cookie to a horizontally stacked edge standing attitude by operating each of the successive surface conveyors at successively decreased velocities;

loading a slug of a predetermined number of cookies onto a cookie loading means, as the slug of cookies is being loaded onto the cookie loading member, moving a separating means downwardly between the foremost cookie to remain on the surface conveyors and the rearmost cookie of the slug of cookies moving onto the loading means;

halting the movement of additional cookies onto the loading means with the separating means and maintaining the vertical standing attitude of the slug of cookies on the loading means;

withdrawing the loading means from beneath the slug of cookies to drop the slug of cookies into a cookie tray positioned beneath said loading means without changing the orientation of the cookies, and returning the loading means to its original loading position with the completion of the loading cycle.

24. The method of claim 23 and further including the steps of measuring the height of the stacked cookies on the surface conveyors and making adjustments to this height by varying the velocities of the surface conveyor next in succession in response to the measured height.

25. The method of 23 and further including the step of counting the cookies to be placed upon said loading means for loading into the tray, and wherein the steps of withdrawing the loading means from beneath the slug of cookies and halting the movement of additional cookies onto the loading means are initiated in response to counting a predetermined number of the cookies.

* * * * *